US005384304A

United States Patent [19]

Kung et al.

[11] Patent Number: 5,384,304

[45] Date of Patent: Jan. 24, 1995

[54] RECEIVING ELEMENT SUBBING LAYER FOR USE IN THERMAL DYE TRANSFER

[75] Inventors: Teh-Ming Kung, Rochester; Brian T. Pope, Penfield, both of N.Y.

[73] Assignee: Eastman Kodak Company, Rochester, N.Y.

[21] Appl. No.: 247,194

[22] Filed: May 20, 1994

[51] Int. Cl.[6] ..... B41M 5/035; B41M 5/38

[52] U.S. Cl. ..... 503/227; 428/195; 428/341; 428/447; 428/448; 428/523; 428/913; 428/914

[58] Field of Search ..... 8/471; 428/195, 341, 428/447, 448, 523, 913, 914; 503/227

[56] References Cited

U.S. PATENT DOCUMENTS 4,965,241 10/1990 Henzel et al. ..... 503/227

*Primary Examiner*—B. Hamilton Hess

*Attorney, Agent, or Firm*—Harold E. Cole

[57] ABSTRACT

Dye-receiving element for thermal dye transfer comprising a polyolefin-coated substrate or a polyolefin substrate having thereon, in order, a subbing layer and a dye image-receiving layer, and wherein the subbing layer comprises a reaction product of a mixture of a) an aminofunctional organo-oxysilane, and b) a hydrophobic organo-oxysilane.

20 Claims, No Drawings

RECEIVING ELEMENT SUBBING LAYER FOR USE IN THERMAL DYE TRANSFER

This invention relates to dye-receiving elements used in thermal dye transfer and, more particularly, to the use of a subbing layer comprising a reaction product of a mixture of two organosilane materials between the substrate and a polymeric dye-receiving layer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

U.S. Pat. No. 4,965,241 relates to the use of a subbing layer for dye-receiving elements comprising a silane having an aminofunctional group. However, there is a problem with this subbing layer when it is subjected to conditions of relative humidity (RH) around 50% or higher for certain time periods. Under those conditions, it delaminates from the support. It would be desirable to improve the stability of dye-receiver elements to higher RH levels which may be encountered during storage and handling.

These and other objects are achieved in accordance with this invention which comprises a dye-receiving element for thermal dye transfer comprising a polyolefin-coated support or a polyolefin support having thereon, in order, a subbing layer and a dye image-receiving layer, wherein the subbing layer comprises a reaction product of a mixture of a) an aminofunctional organo-oxysilane, and b) a hydrophobic organo-oxysilane.

The aminofunctional organo-oxysilane useful in the invention is more fully described in U.S. Pat. No. 4,965,241, the disclosure of which is hereby incorporated by reference.

For the purpose of this invention, "organo-oxysilane" is defined as $X_{4-m}Si(OR)_m$, where X and R represent substituted or unsubstituted hydrocarbon substituents and m equals 1, 2 or 3. "Aminofunctional organo-oxysilane" is defined as an organo-oxysilane as set forth above wherein at least one X substituent contains a terminal or internal amine function. Such compounds can be prepared by conventional techniques and are commercially available.

Specific examples of such aminofunctional organo-oxysilanes are $H_2N(CH_2)_3Si(OC_2H_5)_3$ (3-aminopropyl triethoxysilane, commercially available as product 11,339-5 of Aldrich Chem. Co.), $H_2N(CH_2)_2NH(CH_2)_3Si(OCH_3)_3$ (N-(2-aminoethyl)-3-aminopropyl-trimethoxysilane, commercially available as product Z-6020 of Dow Corning Co.), $H_2N(CH_2)_2NH(CH_2)_2NH(CH_2)_3Si(OCH_3)_3$ (trimethoxysilylpropyl-diethylenetriamine, commercially available as product T-2910 of Petrarch Systems, Inc.), Prosil 221 ® 3-aminopropyl triethoxysilane (PCR Inc.), and Prosil 3128 ® N-(2-aminoethyl)-3-aminopropyl-trimethoxysilane (PCR Inc.).

In a further preferred embodiment of the invention, the aminofunctional organo-oxysilane used in the invention has the following formula:

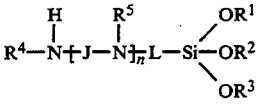

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms;

$R^4$ and $R^5$ each independently represents hydrogen or the same groups as $R^1$, $R^2$ and $R^3$;

J and L each independently represents hydrocarbon linking moieties of from 1 to about 12 carbon atoms, such as $—CH_2—$, $—CH(CH_3)—$, $—C_6H_4—$ or combinations thereof; and n is 0 or a positive integer up to 6.

In a preferred embodiment, J and L are $—C_xH_{2x}$-linking moieties of from 1 to 10 carbon atoms, $R^1$, $R^2$ and $R^3$ are each alkyl groups and n is 0, 1 or 2.

The hydrophobic organo-oxysilanes useful in the invention are formed from a non-substituted alkyl- or aryl-organo-oxysilane. For the purpose of this invention, "hydrophobic organo-oxysilane," is defined as $Y_{4-m}Si(OR)_m$, where Y represents a non-substituted alkyl or aryl group, R represents a substituted or unsubstituted hydrocarbon substituents and m equals 1, 2 or 3. Such silanes can be prepared by conventional techniques and are commercially available. In a preferred embodiment of the invention, the hydrophobic organo-oxysilane also contains an epoxy-terminated organo-oxysilane.

In a further preferred embodiment of the invention, the hydrophobic organo-oxysilane used in the invention has the following formula:

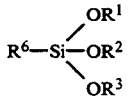

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms; and $R^6$ is a nonsubstituted alkyl group having from about 1 to about 10 carbon atoms, or a nonsubstituted aryl group having from about 5 to about 10 carbon atoms.

Specific examples of such hydrophobic organo-oxysilanes are Prosil 178® isobutyl triethoxysilane (PCR Inc.) and Prosil 9202® N-octyl triethoxysilane (PCR Inc.). Prosil 2210® (PCR Inc.) is an example of an epoxy-terminated organo-oxysilane blended with a hydrophobic organo-oxysilane.

When the two silanes described above are mixed together to form the subbing layer reaction product, it is believed that they will react with each other to form silicon-oxide bonds. It is believed that the reaction product will also form physical bonds with the polymeric dye image-receiving layer and chemical bonds with the polyolefin layer.

The ratios of the two silanes used in the subbing layer may vary widely. For example, good results have been obtained with ratios of from 3:1 to 1:3. In a preferred embodiment, a ratio of 1:1 is used.

The subbing layer of the invention may be employed at any concentration which is effective for the intended purpose. In general, good results have been obtained at a coverage of from about 0.005 to about 0.5 g/m$^2$ of the element, preferably from about 0.05 to about 0.3 g/m$^2$.

The support for the dye image-receiving elements of the invention may comprise a polyolefin monolayer, or may comprise a polyolefin layer coated on a substrate. In a preferred embodiment of the invention, a paper substrate having thereon a polyolefin layer such as polypropylene is used. In a further preferred embodiment, a paper substrate having thereon a mixture of polypropylene and polyethylene is used. Such substrates are described more fully in U.S. Pat. No. 4,999,335, the disclosure of which is hereby incorporated by reference. The polyolefin layer on the paper substrate is generally applied at about 10 to about 100 g/m$^2$, preferably about 20 to about 50 g/m$^2$. Synthetic supports having a polyolefin layer may also be used. Preferably, the polyolefin layer of the substrate is subjected to a corona discharge treatment prior to being coated with the subbing layer of the invention.

The dye image-receiving layer of the receiving elements of the invention may comprise, for example, a polycarbonate, a polyurethane, a polyester, polyvinyl chloride, poly(styrene-co-acrylonitrile), polycaprolactone or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657, the disclosure of which is incorporated by reference.

Dye-donor elements that are used with the dye-receiving element of the invention conventionally comprise a support having thereon a dye-containing layer. Any dye can be used in the dye-donor element employed in the invention provided it is transferable to the dye-receiving layer by the action of heat. Especially good results have been obtained with sublimable dyes. Dye-donor elements applicable for use in the present invention are described, e.g., in U.S. Pat. Nos. 4,916,112, 4,927,803 and 5,023,228, the disclosures of which are hereby incorporated by reference.

As noted above, dye-donor elements are used to form a dye transfer image. Such a process comprises image-wise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH$_7$-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention.

EXAMPLE 1

Subbing layer coating solutions were prepared by mixing one of the following aminofunctional organo-oxysilanes: Prosil 221®, Prosil 3128® or Z-6020 with a hydrophobic organo-oxysilane, Prosil 2210®, which also contains an epoxy-terminated organo-oxysilane. Five different weight ratios of these components in an ethanol-methanol-water solvent mixture were tested as indicated in Table 1. Each of the resultant test solutions contained approximately 1% of silane component, 1% water, and 98% of 3A alcohol.

The test solutions were coated onto a support of Oppalyte® polypropylene-laminated paper :support with a lightly $TiO_2$-pigmented polypropylene skin (Mobil Chemical Co.) at a dry coverage of 0.11 g/m$^2$. Prior to coating, the support was subjected..to a corona discharge treatment at approximately 450 joules/m$^2$.

Each subbing layer test sample was overcoated with a dye-receiving layer containing Makrolon® KL3-1013 polyether-modified bisphenol-A polycarbonate block copolymer (Bayer AG) (1.83 g/m$^2$), GE Lexan® 141-112 bisphenol-A polycarbonate (General Electric Co.) (1.61 g/m$^2$), Fluorad FC-431® perfluorinated alkylsulfonamidoalkyl ester surfactant (3M Co.) (0.011 g/m$^2$), di-n-butyl phthalate (0.33 g/m$^2$), and diphenyl phthalate (0.33 g/m$^2$) coated from methylene chloride.

The dye-receiving layer was then overcoated with a solvent mixture of methylene chloride and trichloroethylene; a polycarbonate random terpolymer of bisphenol A (50 mole %), diethylene glycol (49 mole %), and polydimethylsiloxane (1 mole %), (2500 MW) block units (0.22 g/m$^2$); Fluorad FC-431 ® surfactant (0.017 g/m$^2$); and DC-510 surfactant (Dow—Corning Corp.) (0.0083 g/m$^2$). The resultant multilayer dye receiver elements were then subjected to the manually conducted tape adhesion test described below after they had been conditioned for one and for seven days, respectively, at 22° C. and 85% RH.

The tape adhesion tests were performed as follows. A small area approximately 1.9 cm×5 cm of 3M Corp. Magic Transparent Tape ® was firmly pressed by hand over the corner of the receiver surface leaving enough area free to serve as a handle for pulling the tape. Upon manually pulling the tape, ideally none of the receiver layer would be removed. Receiver layer removal indicated a weak bond between the polyolefin paper support and the polycarbonate dye-receiving layer.

The following categories were established for ranking adhesion:

E: excellent (no receiver layer removal even after repeated attempts to peel off the tape)

F: fair (partial receiver layer removal and adhesion failure occur at repeated pull)

P: poor or unacceptable (adhesion failure occurs easily)

The following results were obtained:

TABLE 1

| SUBBING LAYER CONSTITUENTS | | | | TAPE TEST | |
|---|---|---|---|---|---|
| AMINOFUNCTIONAL ORGANO-OXYSILANE | HYDROPHOBIC ORGANO-OXYSILANE | WEIGHT RATIO | DRY COVERAGE g/m$^2$ | AFTER 1 DAY | INCUBATION 7 DAYS |
| Controls | | | | | |
| DOW Z6020 | None | 1:0 | 0.11 | P | P |
| Prosil 3128 ® | None | 1:0 | 0.11 | P | P |
| Prosil 221 ® | None | 1:0 | 0.11 | P | P |
| None | Prosil 2210 ® | 0:1 | 0.11 | P | P |
| Invention | | | | | |
| Prosil 221 ® | Prosil 2210 ® | 3:1 | 0.08/0.02 | F | F |
| Prosil 221 ® | Prosil 2210 ® | 1:1 | 0.05/0.05 | E | E |
| Prosil 221 ® | Prosil 2210 ® | 1:3 | 0.02/0.08 | F | F |
| Prosil 3128 ® | Prosil 2210 ® | 3:1 | 0.08/0.02 | F | F |
| Prosil 3128 ® | Prosil 2210 ® | 1:1 | 0.05/0.05 | E | E |
| Prosil 3128 ® | Prosil 2210 ® | 1:3 | 0.02/0.08 | F | F |

The above results indicate an improved subbing layer adhesion resulted when a hydrophobic organo-oxysilane was used in combination with an aminofunctional organo-oxysilane. The best results were obtained using a ratio of 1:1. The above silanes used alone (controls) gave poor adhesion at the above conditions.

EXAMPLE 2

Subbing layer coating solutions were prepared by mixing Prosil 221 ® with either Prosil 178 ® or Prosil 9202 ® at five different weight ratios in an ethanol-methanol-water solvent mixture. Again, the resulting coating solutions had overall contents of approximately 1% silanes, 1% water, and 98% 3A alcohol. These solutions were coated onto the same corona-treated paper support and overcoated with the same dye-receiving layer as in Example 1.

Each dye-receiving element was then tested as in Example 1 with the following results:

TABLE 2

| SUBBING LAYER CONSTITUENTS | | | | TAPE TEST | |
|---|---|---|---|---|---|
| AMINOFUNCTIONAL ORGANO-OXYSILANE | HYDROPHOBIC ORGANO-OXYSILANE | WEIGHT RATIO | DRY COVERAGE g/m$^2$ | AFTER 1 DAY | INCUBATION 7 DAYS |
| Controls | | | | | |
| Prosil 221 ® | None | 1:0 | 0.11 | P | P |
| None | Prosil 178 ® | 0:1 | 0.11 | P | P |
| None | Prosil 9202 ® | 0:1 | 0.11 | P | P |
| Invention | | | | | |
| Prosil 221 ® | Prosil 178 ® | 3:1 | 0.08/0.02 | F | F |
| Prosil 221 ® | Prosil 178 ® | 1:1 | 0.05/0.05 | E | E |
| Prosil 221 ® | Prosil 178 ® | 1:3 | 0.02/0.08 | F | F |
| Prosil 221 ® | Prosil 9202 ® | 3:1 | 0.08/0.02 | F | F |
| Prosil 221 ® | Prosil 9202 ® | 1:1 | 0.05/0.05 | E | E |
| Prosil 221 ® | Prosil 9202 ® | 1:3 | 0.02/0.08 | F | F |

The above results again indicate an improved subbing layer adhesion resulted when a hydrophobic organo-oxysilane was used in combination with an aminofunctional organo-oxysilane. The best results were obtained using a ratio of 1:1. The above silanes used alone (controls) gave poor adhesion at the above conditions.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a polyolefin-coated substrate or a polyolefin substrate having thereon, in order, a subbing layer and a dye image-receiving layer, and wherein the subbing layer comprises a reaction product of a mixture of a) an aminofunctional organo-oxysilane, and b) a hydrophobic organo-oxysilane.

2. The dye-receiving element of claim 1 wherein the support is a polypropylene-coated substrate or polypropylene.

3. The dye-receiving element of claim 1 wherein the dye image-receiving layer contains a thermally-transferred dye image.

4. The dye-receiving element of claim 1 wherein the ratio of the two silanes is 1:1.

5. The dye-receiving element of claim 1 wherein the subbing layer is coated at a coverage of from about 0.005 to about 0.5 $g/m^2$.

6. The dye-receiving element of claim 1 wherein the aminofunctional organo-oxysilane has the following structure:

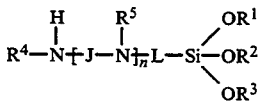

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms;

$R^4$ and $R^5$ each independently represents hydrogen or the same groups as $R^1$, $R^2$ and $R^3$;

J and L each independently represents hydrocarbon linking moieties of from 1 to about 12 carbon atoms; and n is 0 or a positive integer up to 6.

7. The dye-receiving element of claim 6 wherein J and L are $-C_xH_{2x}$-linking moieties of from 1 to 10 carbon atoms, $R^1$, $R^2$ and $R^3$ are each alkyl groups and n is 0, 1 or 2.

8. The dye-receiving element of claim 6 wherein the aminofunctional organo-oxysilane is N-(2-aminoethyl)-3-aminopropyl-trimethoxysilane.

9. The dye-receiving element of claim 6 wherein the aminofunctional organo-oxysilane is 3-aminopropyl triethoxysilane.

10. The dye-receiving element of claim 1 wherein the hydrophobic organo-oxysilane is a nonsubstituted, alkyl- or aryl-organo-oxysilane.

11. The dye-receiving element of claim 1 wherein the hydrophobic organo-oxysilane has the formula:

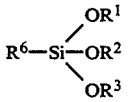

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms; and $R^6$ is a nonsubstituted alkyl group having from about 1 to about 10 carbon atoms, or a nonsubstituted aryl group having from about 5 to about 10 carbon atoms.

12. The dye-receiving element of claim 11 which also contains an epoxy-functionalized organo-oxysilane.

13. The dye-receiving element of claim 11 wherein the hydrophobic organo-oxysilane is isobutyl triethoxysilane.

14. The dye-receiving element of claim 11 wherein the hydrophobic organo-oxysilane is N-octyl triethoxysilane.

15. A process of forming a dye transfer image comprising:

a) imagewise-heating a dye-donor element comprising a support having thereon a dye layer comprising a dye dispersed in a binder, and b) transferring a dye image to a dye-receiving element comprising a support having thereon a dye image-receiving layer to form said dye transfer image, wherein the receiving element comprises a polyolefin-coated substrate or a polyolefin substrate having thereon, in order, a subbing layer and a dye image-receiving layer, and wherein the subbing layer comprises a reaction product of a mixture of a) an aminofunctional organo-oxysilane, and b) a hydrophobic organo-oxysilane.

16. The process of claim 15 wherein the aminofunctional organo-oxysilane has the following structure:

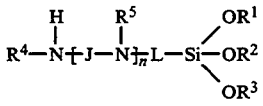

wherein $R^1$, $R^2$ and $R^3$ each independently represents a substituted or unsubstituted group having from one to about 10 carbon atoms, a substituted or unsubstituted aryl group having from about 5 to about 10 carbon atoms, or a substituted or unsubstituted carbocyclic group having from about 5 to about 10 carbon atoms;

$R^4$ and $R^5$ each independently represents hydrogen or the same groups as $R^1$, $R^2$ and $R^3$;

J and L each independently represents hydrocarbon linking moieties of from 1 to about 12 carbon atoms; and n is 0 or a positive integer up to 6.

17. The process of claim 15 wherein the hydrophobic organo-oxysilane has the formula:

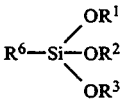

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms; and $R^6$ is a nonsubstituted alkyl group having from about 1 to about 10 carbon atoms, or a nonsubstituted aryl group having from about 5 to about 10 carbon atoms.

18. A thermal dye transfer assemblage comprising:

a) a dye-donor element comprising a support having thereon a dye layer comprising a dye dispersed in a binder, and b) a dye-receiving element comprising a support having thereon a dye image-receiving layer, said dye-receiving element being in a superposed relationship with said dye-donor element so that said dye layer is in contact with said dye image-receiving layer, wherein the receiving element comprises a polyolefin-coated substrate or a polyolefin substrate having thereon, in order, a subbing layer and a dye image-receiving layer, and wherein the subbing layer comprises a reaction product of a mixture of a) an aminofunctional organo-oxysilane, and b) a hydrophobic organo-oxysilane.

19. The assemblage of claim 18 wherein the aminofunctional organo-oxysilane has the following structure:

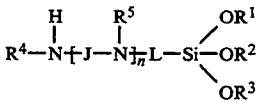

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms;

$R^4$ and $R^5$ each independently represents hydrogen or the same groups as $R^1$, $R^2$ and $R^3$;

J and L each independently represents hydrocarbon linking moieties of from 1 to about 12 carbon atoms; and n is 0 or a positive integer up to 6.

20. The assemblage of claim 18 wherein the hydrophobic organo-oxysilane has the formula:

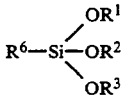

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms; and $R^6$ is a nonsubstituted alkyl group having from about 1 to about 10 carbon atoms, or a nonsubstituted aryl group having from about 5 to about 10 carbon atoms.

* * * * *